US010981693B2

(12) United States Patent
Spivey, Sr.

(10) Patent No.: US 10,981,693 B2
(45) Date of Patent: Apr. 20, 2021

(54) DISPLAY/VENDING CARTON

(71) Applicant: Graphic Packaging International, Inc., Atlanta, GA (US)

(72) Inventor: Raymond R. Spivey, Sr., Mableton, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 533 days.

(21) Appl. No.: 14/520,684

(22) Filed: Oct. 22, 2014

(65) Prior Publication Data

US 2015/0033678 A1 Feb. 5, 2015

Related U.S. Application Data

(63) Continuation of application No. 13/772,494, filed on Feb. 21, 2013, now abandoned, which is a continuation of application No. 12/552,492, filed on Sep. 2, 2009, now abandoned, which is a continuation of application No. 11/331,948, filed on Jan. 13, 2006, now Pat. No. 7,614,497, which is a continuation of application No. 10/770,762, filed on Feb. 3, 2004, now Pat. No. 7,004,897.

(Continued)

(51) Int. Cl.

| | |
|---|---|
| ***B31B 50/00*** | (2017.01) |
| ***B65D 5/54*** | (2006.01) |
| ***B65D 5/52*** | (2006.01) |
| ***B65D 71/36*** | (2006.01) |
| ***B65D 77/38*** | (2006.01) |
| *B31B 105/00* | (2017.01) |

(52) U.S. Cl.

CPC ..... *B65D 5/5405* (2013.01); *B31B 50/00* (2017.08); *B65D 5/5233* (2013.01); *B65D 71/36* (2013.01); *B65D 77/38* (2013.01); *B31B 2105/00* (2017.08); *B65D 2571/0058* (2013.01)

(58) Field of Classification Search

CPC ..... B65D 77/38; B65D 5/52; B65D 17/00; B65D 5/54; B65D 71/00; B65D 71/36; A47F 1/04

USPC ..... 493/51, 114; 229/223, 243, 244; 221/305, 303, 302; 206/427, 746

See application file for complete search history.

(56) References Cited

U.S. PATENT DOCUMENTS

| | | | |
|---|---|---|---|
| 902,347 | A | 10/1908 | Tillinghast |
| 1,497,536 | A | 6/1924 | Billstein |
| 1,541,143 | A | 6/1925 | Hoile |

(Continued)

FOREIGN PATENT DOCUMENTS

| | | |
|---|---|---|
| CA | 874828 | 6/1971 |
| CA | 2 246 020 | 2/2000 |
| DE | 2 323 589 | 11/1974 |
| DE | 75 10 538 | 8/1975 |

(Continued)

OTHER PUBLICATIONS

Notification of Reason for Refusal and English Translation for Application No. 2006-535583, dated May 16, 2011.

(Continued)

*Primary Examiner* — Chelsea E Stinson
*Assistant Examiner* — Mary C Hibbert-Copeland
(74) *Attorney, Agent, or Firm* — Womble Bond Dickinson (US) LLP

(57) ABSTRACT

A carton with an improved dispensing feature at one end of the carton, which preserves the integrity of the carton, while enabling the display and enhanced access and vending of containers within the carton.

29 Claims, 4 Drawing Sheets

Related U.S. Application Data

(60) Provisional application No. 60/511,586, filed on Oct. 15, 2003.

(56) References Cited

U.S. PATENT DOCUMENTS

| | | | |
|---|---|---|---|
| 1,609,186 | A | 11/1926 | Peruzzi |
| 1,853,219 | A | 4/1932 | Newton |
| 1,925,102 | A | 9/1933 | Levkoff |
| 2,026,477 | A | 12/1935 | Lescher |
| 2,067,749 | A | 1/1937 | Zimmerman et al. |
| 2,115,673 | A | 4/1938 | Stompe |
| 2,124,808 | A | 7/1938 | White et al. |
| 2,278,793 | A | 4/1942 | Myers |
| 2,294,964 | A | 9/1942 | Davidson |
| 2,294,965 | A | 9/1942 | Davidson |
| 2,316,796 | A | 4/1943 | Lichter |
| 2,448,819 | A | 9/1948 | Mitchell |
| 2,473,635 | A | 6/1949 | Buttery |
| 2,619,226 | A | 11/1952 | Adams |
| 2,718,301 | A | 9/1955 | Palmer |
| 2,723,027 | A | 11/1955 | Guyer |
| 2,754,047 | A | 7/1956 | Schmidt et al. |
| 2,842,304 | A | 7/1958 | Ringler |
| 2,844,298 | A | 7/1958 | Tamarin |
| 2,868,431 | A | 1/1959 | Painter |
| 2,919,844 | A | 1/1960 | Anderson, Jr. |
| 2,930,516 | A | 3/1960 | Fowle et al. |
| 2,975,891 | A | 3/1961 | Stone |
| 2,990,097 | A | 6/1961 | Thompson |
| 3,002,651 | A | 10/1961 | Gauld |
| 3,018,031 | A | 1/1962 | Ahlbor et al. |
| 3,178,242 | A | 4/1965 | Ellis et al. |
| 3,228,582 | A | 1/1966 | Osberg |
| 3,263,861 | A | 8/1966 | Carr |
| 3,265,283 | A | 8/1966 | Farquhar |
| RE26,083 | E | 9/1966 | Forrer |
| 3,270,941 | A | 9/1966 | Barnes |
| 3,300,115 | A | 1/1967 | Schauer |
| 3,332,594 | A | 7/1967 | De Capua |
| 3,356,279 | A | 12/1967 | Root |
| 3,416,719 | A | 12/1968 | Pilger |
| 3,517,858 | A | 6/1970 | Farquhar |
| 3,540,581 | A | 11/1970 | Koolnis |
| 3,599,858 | A | 8/1971 | Samsing |
| 3,602,392 | A | 8/1971 | Cote |
| 3,669,251 | A | 6/1972 | Phillips, Jr. |
| 3,696,990 | A | 10/1972 | Dewhurst |
| 3,765,527 | A | 10/1973 | Vargo |
| 3,784,022 | A | 1/1974 | Beesley, Jr. |
| 3,894,681 | A | 7/1975 | Arneson et al. |
| 3,913,739 | A | 10/1975 | Hennessey |
| 3,933,303 | A | 1/1976 | Kirby |
| 3,942,631 | A | 3/1976 | Sutherland et al. |
| 3,952,872 | A | 4/1976 | Consiglio, Jr. |
| 3,961,706 | A | 6/1976 | Roccaforte et al. |
| 4,000,811 | A | 1/1977 | Hardison et al. |
| D243,508 | S | 3/1977 | Killy |
| 4,030,596 | A | 6/1977 | Snyder et al. |
| D252,259 | S | 7/1979 | Rinehart |
| 4,214,660 | A | 7/1980 | Hunt, Jr. |
| 4,216,861 | A | 8/1980 | Oliff |
| 4,222,485 | A | 9/1980 | Focke |
| 4,252,236 | A | 2/1981 | Roccaforte |
| D263,204 | S | 3/1982 | Dutcher |
| 4,318,474 | A | 3/1982 | Hasegawa |
| 4,325,482 | A | 4/1982 | Feeser |
| 4,331,289 | A | 5/1982 | Killy |
| 4,334,644 | A | 6/1982 | Hauser |
| 4,340,170 | A | 7/1982 | Montealegre |
| 4,364,509 | A | 12/1982 | Holley, Jr. et al. |
| 4,375,258 | A | 3/1983 | Crayne et al. |
| 4,378,877 | A | 4/1983 | Botterman et al. |
| D269,068 | S | 5/1983 | Mann, Sr. et al. |
| D270,041 | S | 8/1983 | Vestal |
| 4,396,143 | A | 8/1983 | Killy |
| 4,405,078 | A | 9/1983 | Dutcher et al. |
| 4,411,365 | A | 10/1983 | Horikawa et al. |
| 4,416,410 | A | 11/1983 | Herrmann |
| 4,417,655 | A | 11/1983 | Forbes, Jr. |
| 4,417,661 | A | 11/1983 | Roccaforte |
| 4,465,180 | A | 8/1984 | Klygis |
| 4,466,536 | A | 8/1984 | Zeitel |
| 4,498,581 | A | 2/1985 | Dutcher |
| 4,519,522 | A | 5/1985 | McElwee |
| 4,558,816 | A | 12/1985 | Wood |
| 4,560,062 | A | 12/1985 | Valiulis |
| 4,577,762 | A | 3/1986 | Kuchenbecker |
| 4,577,799 | A | 3/1986 | Oliff |
| 4,582,199 | A | 4/1986 | Schuster |
| 4,588,084 | A | 5/1986 | Holley, Jr. |
| 4,598,810 | A | 7/1986 | Shore et al. |
| 4,605,128 | A | 8/1986 | Rieke |
| D286,987 | S | 12/1986 | Golan et al. |
| 4,706,876 | A | 11/1987 | Wilson |
| 4,726,471 | A | 2/1988 | Whately et al. |
| 4,756,419 | A | 7/1988 | Le Bras |
| 4,785,991 | A | 11/1988 | Schuster |
| 4,805,800 | A | 2/1989 | Nocek et al. |
| 4,817,866 | A | 4/1989 | Wonnacott |
| D303,090 | S | 8/1989 | Armor et al. |
| 4,860,944 | A | 8/1989 | Wonnacott |
| 4,871,067 | A | 10/1989 | Valenti |
| 4,890,440 | A | 1/1990 | Romagnoli |
| 4,919,266 | A | 4/1990 | McIntosh, Jr. et al. |
| 4,949,845 | A | 8/1990 | Dixon |
| 4,961,507 | A | 10/1990 | Higgins |
| 4,966,324 | A | 10/1990 | Steel |
| 4,972,991 | A | 11/1990 | Schuster |
| 4,974,731 | A | 12/1990 | Wood |
| 4,974,771 | A | 12/1990 | Lavery |
| 4,981,253 | A | 1/1991 | Quaintance |
| 4,982,845 | A | 1/1991 | Prascak et al. |
| 4,989,778 | A | 2/1991 | Saulas |
| 5,002,186 | A | 3/1991 | Cooper |
| 5,031,825 | A | 7/1991 | Romagnoli |
| D321,134 | S | 10/1991 | Toinet |
| 5,067,615 | A | 11/1991 | Davitian |
| 5,072,876 | A | 12/1991 | Wilson |
| 5,101,642 | A | 4/1992 | Alexandrov |
| 5,106,014 | A | 4/1992 | Miller |
| 5,123,589 | A | 6/1992 | Cote |
| 5,137,211 | A | 8/1992 | Summer et al. |
| 5,143,252 | A | 9/1992 | Shi |
| 5,170,934 | A | 12/1992 | Lemoine |
| D332,915 | S | 2/1993 | Hoell et al. |
| 5,205,436 | A | 4/1993 | Savage |
| 5,219,229 | A | 6/1993 | Sengewald |
| 5,249,681 | A | 10/1993 | Miller |
| 5,265,798 | A | 11/1993 | DeMaio et al. |
| 5,277,360 | A | 1/1994 | DeMott |
| 5,279,440 | A | 1/1994 | Fougeres et al. |
| 5,284,292 | A | 2/1994 | Johnson |
| 5,289,943 | A | 3/1994 | Powell |
| 5,292,059 | A | 3/1994 | Oliff |
| 5,297,725 | A | 3/1994 | Sutherland |
| 5,333,734 | A | 8/1994 | Stout et al. |
| 5,337,920 | A | 8/1994 | Clausen |
| 5,348,219 | A | 9/1994 | Brintazzoli |
| 5,368,194 | A | 11/1994 | Oliff et al. |
| 5,372,299 | A | 12/1994 | Edgerton, Jr. et al. |
| 5,385,234 | A | 1/1995 | Stout et al. |
| 5,402,933 | A | 4/1995 | Behrmann |
| 5,425,474 | A | 6/1995 | Dalea et al. |
| 5,427,242 | A | 6/1995 | Oliff et al. |
| 5,437,407 | A | 8/1995 | Kim |
| 5,439,168 | A | 8/1995 | Kim |
| 5,465,831 | A | 11/1995 | Smith |
| 5,482,185 | A | 1/1996 | McNaughton |
| 5,482,203 | A | 1/1996 | Stout |
| 5,505,372 | A | 4/1996 | Edson et al. |
| 5,518,111 | A | 5/1996 | Stout |
| 5,577,612 | A | 11/1996 | Chesson et al. |
| 5,597,114 | A | 1/1997 | Kramedjian et al. |
| 5,622,309 | A | 4/1997 | Matsuda et al. |

(56) References Cited

U.S. PATENT DOCUMENTS

D379,759 S 6/1997 Mulry
5,657,872 A 8/1997 Leftwich et al.
5,664,683 A 9/1997 Brody
5,682,984 A 11/1997 Hoell et al.
5,690,213 A 11/1997 Matsumura
5,699,957 A 12/1997 Blin et al.
5,722,584 A 3/1998 Fujiwara
5,772,030 A 6/1998 Baxter
5,775,574 A 7/1998 Whitnell
5,788,117 A 8/1998 Zimmanck
5,826,783 A 10/1998 Stout
5,833,118 A 11/1998 Weiss
5,857,614 A 1/1999 Walsh
5,873,515 A 2/1999 Dunn et al.
5,875,961 A 3/1999 Stone et al.
5,878,947 A 3/1999 Hoy et al.
5,881,884 A 3/1999 Podosek
5,921,398 A 7/1999 Carroll
5,924,559 A 7/1999 Carrel et al.
5,996,797 A 12/1999 Flaig
6,019,276 A 2/2000 Auclair
6,105,854 A 8/2000 Spivey et al.
6,106,856 A 8/2000 Kakiuchi
6,155,480 A 12/2000 Botsford et al.
6,158,579 A * 12/2000 Rosenbaum ..... B65D 5/48026 206/45.29
D436,859 S 1/2001 Botsford et al.
6,170,741 B1 1/2001 Skolik et al.
6,176,419 B1 1/2001 Holley, Jr.
6,209,786 B1 4/2001 Yelton et al.
6,244,436 B1 6/2001 Boriani et al.
6,253,930 B1 7/2001 Freidus et al.
6,273,330 B1 8/2001 Oliff et al.
6,283,293 B1 9/2001 Lingamfelter
D454,784 S 3/2002 Oram
6,371,365 B1 * 4/2002 Doucette ..... B65D 5/5445 229/120.011
6,386,369 B2 5/2002 Yuhas et al.
6,386,438 B1 5/2002 Walsh et al.
6,390,290 B1 5/2002 Focke et al.
6,409,077 B1 6/2002 Telesca et al.
D459,927 S 7/2002 Flowers et al.
6,435,351 B1 * 8/2002 Gibb ..... B65D 5/542 206/736
6,457,580 B1 10/2002 Focke et al.
6,474,469 B1 11/2002 Luton et al.
6,478,219 B1 11/2002 Holley, Jr.
6,484,903 B2 11/2002 Spivey et al.
6,550,615 B2 4/2003 Lingamfelter
6,557,699 B1 5/2003 Focke et al.
6,578,736 B2 6/2003 Spivey
6,631,803 B2 10/2003 Rhodes et al.
6,669,083 B2 12/2003 Bates
6,715,639 B2 4/2004 Spivey
6,752,262 B1 6/2004 Boriani et al.
6,789,673 B2 9/2004 Lingamfelter
6,866,185 B2 3/2005 Harrelson
6,902,104 B2 6/2005 Holley, Jr. et al.
6,918,487 B2 7/2005 Harrelson
6,929,172 B2 8/2005 Bates et al.
6,991,107 B2 1/2006 Harrelson
6,997,316 B2 2/2006 Sutherland
7,000,824 B2 2/2006 Saulas
7,004,897 B2 2/2006 Spivey, Sr.
7,048,817 B1 5/2006 Hammond
7,059,494 B2 6/2006 Harrelson et al.
7,100,798 B2 9/2006 Spivey
7,104,435 B2 9/2006 Holley, Jr.
7,134,551 B2 11/2006 Harrelson
7,175,047 B2 2/2007 Spivey
7,237,674 B2 7/2007 Auclair
7,467,713 B2 12/2008 Harrelson
7,523,842 B2 4/2009 Spivey
7,614,497 B2 11/2009 Spivey, Sr.
7,648,060 B2 1/2010 DeBusk
7,780,003 B2 8/2010 Harrelson
7,946,451 B2 5/2011 Spivey
8,123,072 B2 2/2012 Spivey
8,302,811 B2 11/2012 Spivey
8,579,154 B2 11/2013 Spivey
8,887,952 B2 11/2014 Spivey
2002/0029991 A1 3/2002 Lingamfelter
2002/0070139 A1 6/2002 Bates
2002/0088820 A1 7/2002 Spivey
2002/0088821 A1 7/2002 Spivey et al.
2002/0185499 A1 12/2002 Harrelson et al.
2002/0185527 A1 12/2002 Bates
2003/0141313 A1 7/2003 Bates
2003/0141353 A1 7/2003 Wilson
2003/0150759 A1 * 8/2003 White, Jr. ..... B65D 5/46016 206/427
2003/0192907 A1 10/2003 Bates
2004/0060972 A1 4/2004 Harrelson
2004/0089575 A1 5/2004 Lingamfelter
2004/0089671 A1 5/2004 Miller
2004/0099558 A1 5/2004 Oliff et al.
2004/0154945 A1 * 8/2004 Harrelson ..... B65D 5/725 206/434
2004/0155098 A1 8/2004 Harrelson
2004/0188277 A1 * 9/2004 Auclair ..... B65D 71/36 206/139
2004/0188300 A1 9/2004 Sutherland
2004/0188508 A1 9/2004 Holley
2005/0023170 A1 2/2005 Lingamfelter
2005/0085364 A1 4/2005 Spivey
2005/0092820 A1 5/2005 Chekroune
2005/0126947 A1 6/2005 Holley, Jr.
2005/0178687 A1 8/2005 Spivey, Sr.
2006/0175386 A1 8/2006 Holley, Jr.
2007/0017966 A1 1/2007 DeBusk et al.
2007/0062834 A1 3/2007 Harrelson

FOREIGN PATENT DOCUMENTS

DE 76 06 493 U1 6/1976
DE 29 33 022 9/1980
DE 30 07 769 9/1981
DE 81 35 176 5/1982
DE 8514718.4 U1 6/1985
DE 86 29 664 5/1987
DE 36 12 594 10/1987
DE 40 23 043 12/1991
DE 94 12 885 10/1994
DE 94 13 813 10/1994
DE 295 19 931 2/1996
DE 296 02 010 3/1996
DE 198 02 800 7/1999
DE 29 909 008 9/1999
DE 299 13 585 10/1999
DE 694 21 620 4/2000
EP 0 235 852 9/1987
EP 0 323 596 A1 7/1989
EP 0 342 088 A1 11/1989
EP 0 475 147 3/1992
EP 0 659 143 6/1995
EP 0 752 370 A2 1/1997
EP 0 849 189 6/1998
EP 0 936 995 8/1999
EP 1 038 783 9/2000
EP 1 060 998 12/2000
EP 1 615 839 A2 1/2006
FR 2 549 010 A1 1/1985
FR 2 683 027 A1 5/1993
FR 2 761 342 A1 10/1998
GB 2 184 999 A 7/1987
GB 2 186 550 A 8/1987
GB 2 189 223 A 10/1987
GB 2 264 101 8/1993
JP 49-18843-01 5/1974
JP 55-61519 4/1980
JP 59-147018 10/1984
JP 60-190680 12/1985
JP 63-111422 7/1988
JP 7-9721 2/1995

(56) References Cited

FOREIGN PATENT DOCUMENTS

| | | | |
|---|---|---|---|
| JP | 10-211924 | | 8/1998 |
| JP | 2000-50947 | | 2/2000 |
| JP | 2006-535583 | | 6/2009 |
| WO | WO 88/09750 | | 12/1988 |
| WO | WO 95/01284 | | 1/1995 |
| WO | WO 95/25668 | | 9/1995 |
| WO | WO 96/29260 | | 9/1996 |
| WO | WO 96/36538 | | 11/1996 |
| WO | WO 97/21607 | | 6/1997 |
| WO | WO 98/31593 | | 7/1998 |
| WO | WO 98/38099 | | 9/1998 |
| WO | WO 99/64301 | | 12/1999 |
| WO | WO 00/03937 | | 1/2000 |
| WO | WO 00/23334 | | 4/2000 |
| WO | WO 00/71428 | A1 | 11/2000 |
| WO | WO 01/28871 | A1 | 4/2001 |
| WO | WO 02/04302 | | 1/2002 |
| WO | WO 02/30785 | | 4/2002 |
| WO | WO 02/085739 | | 10/2002 |
| WO | WO 2004/043790 | A2 | 5/2004 |
| WO | WO 2005/037663 | A1 | 4/2005 |
| WO | WO 2005/051777 | | 6/2005 |
| WO | WO 2005/051782 | | 6/2005 |

OTHER PUBLICATIONS

Office Action for U.S. Appl. No. 12/552,492, dated Apr. 6, 2011.
Amendment A and Response to Office Action for U.S. Appl. No. 12/552,492, dated Jul. 20, 2011.
Final Office Action for U.S. Appl. No. 12/552,492, dated Sep. 22, 2011.
Request for Continued Examination (RCE) Transmittal for U.S. Appl. No. 12/552,492, dated Jan. 20, 2012.
Amendment B and Response to Office Action for U.S. Appl. No. 12/552,492, dated Jan. 20, 2012.
Office Action for U.S. Appl. No. 12/552,492, dated Aug. 2, 2012.
Amendment C and Response to Office Action for U.S. Appl. No. 12/552,492, dated Nov. 2, 2012.
Final Office Action for U.S. Appl. No. 12/552,492, dated Nov. 21, 2012.
Response to Final Office Action for U.S. Appl. No. 12/552,492, dated Feb. 21, 2013.
Advisory Action for U.S. Appl. No. 12/552,492, dated Mar. 1, 2013.
Notice of Abandonment for U.S. Appl. No. 12/552,492, dated Jun. 3, 2013.
"Dispensing Multipack, Coke Canner Rolls Out 'Fridge-Friendly' Pack," Packaging World, Sep. 2001, p. 2, [Summit Publishing Company—Chicago].
"Hot Hit With Consumers," International Bottler & Packer, Nov. 2001 [Binstead Publications Ltd.].
"Coke Bottler Tests A Slimmer Soda Package", Wall Street Journal B3 (Aug. 10, 2001).
"Passing the Torch", Beverage World p. 36 (Oct. 2002).
"Riverwood" For the Carton Designated as 'Fridge Pack,' International Bottler & Packer, Nov. 2001 [Binstead Publications Limited—United Kingdom].
"Coca-Cola Fridge Mate", p. 3 Revise Woolworth's Advertisement wca4000 / N1A.

* cited by examiner

DISPLAY/VENDING CARTON

CROSS REFERENCE TO RELATED APPLICATIONS

The present application is a continuation of U.S. patent application Ser. No. 13/772,494, filed Feb. 21, 2013, which is a continuation of U.S. patent application Ser. No. 12/552,492, filed Sep. 2, 2009, now abandoned, which is a continuation of U.S. patent application Ser. No. 11/331,948, filed Jan. 13, 2006, now U.S. Pat. No. 7,614,497, which is a continuation of U.S. patent application Ser. No. 10/770,762, filed Feb. 3, 2004, now U.S. Pat. No. 7,004,897, which application claims the benefit of U.S. Provisional Patent Application No. 60/511,586, filed Oct. 15, 2003.

INCORPORATION BY REFERENCE

The disclosures of U.S. patent application Ser. No. 13/772,494, which was filed on Feb. 21, 2013, U.S. patent application Ser. No. 12/552,492, which was filed on Sep. 2, 2009, U.S. patent application Ser. No. 11/331,948, which was filed on Jan. 13, 2006, U.S. patent application Ser. No. 10/770,762, which was filed on Feb. 3, 2004, and U.S. Provisional Patent Application No. 60/511,586, which was filed on Oct. 15, 2003, are hereby incorporated by reference for all purposes as if presented herein in their entirety.

FIELD OF THE INVENTION

The present invention generally relates to cartons for storage and transport of articles, and in particular, to paperboard cartons incorporating an opening feature so as to define a dispenser for the display and vending of articles or containers stored within the carton.

BACKGROUND OF THE INVENTION

Cartons made from cardboard, paperboard, or similar materials have long been used for the storage and transport of various types of articles such as beverage cans and other foodstuffs. For example, beverages, such as soft drinks and beer, contained within bottles or cans typically are packaged in six, eight, twelve, or even twenty-four pack configurations within paperboard or cardboard cartons. Such cartons have not only been used for the storage and transport of containers such as bottles or cans, but further have been developed with dispensing features including tear-away sections of the cartons to enable dispensing of the articles contained therein. Some of these dispensers, however, suffer from the disadvantage that, once opened, there will be a tendency for more than one container, especially bottles or cans stored therein, to roll out of the carton. Alternatively, many conventional dispensing cartons are provided with dispensing or opening features that often are a limited size or volume to restrict the number of articles that can be removed at any one time, but which also can make it difficult to easily and cleanly remove the containers or other articles stored within the carton. Still further, in retail environments, it is important that products not only be easily accessible to consumers, but also be prominently displayed, which traditionally has led retailers to remove all of the containers or articles from their carton for stacking on shelves for display and easier access.

Accordingly, it can be seen that a need exists for a carton for various types of articles such as beverage cans and other similar articles, which enables the dispensing of the articles substantially one at a time and which addresses the foregoing and other related and unrelated problems in the art.

SUMMARY OF THE INVENTION

Briefly described, the present invention generally relates to a display/vending carton for the storage, transport, display and dispensing or vending of containers stored within the carton. The carton typically will be formed from paperboard, cardboard, or other similar material initially formed as a carton blank. As the carton blank is fed into a packaging machine, the carton blank will be folded into a sleeve in which a series of articles or containers such as beverage cans or bottles, tubes of frozen biscuits, etc., will be loaded or the carton blank otherwise will be folded or wrapped about the articles. The articles or containers typically are loaded in vertically stacked, substantially parallel rows, with there generally being 2-3 rows or more of the containers stacked within the carton. The ends of the carton thereafter will be folded closed and secured such as by adhesive or other fastening mechanism to form an enclosed, display/vending carton.

In one example embodiment, the carton blank will include a top panel attached to a first side panel along a first fold line, and to a second side panel along an opposite side thereof, by a second fold line. Each of the side panels can be connected along third and fourth fold lines to bottom flaps, with the bottom flaps designed to be folded and glued together so as to form or define a bottom panel of the enclosed carton. Alternatively, a bottom panel can be attached to the opposite side of the first side panel from the top panel by the third fold line, while an attachment flap is attached to the second side panel along an opposite edge from the top panel by the fourth fold line. Additionally, fifth and sixth transverse fold lines extend across the bottom side and top panels in a direction normal to the first through fourth longitudinal fold lines, so as to define bottom, side and top end flaps. The end flaps are adapted to be folded together in an overlying configuration for enclosing the ends of the carton after folding of the blank into a sleeve for loading with products and containers therein. One of these closed ends further will be an exiting end at which a dispenser is formed for removal or dispensing of products or containers from the enclosed carton.

A line of weakness or separation generally is formed in the carton at its exiting end and typically includes a series of perforations, cuts, and/or scores so as to define a tear line for a removable opening section of the carton at its exiting end. This enables the opening section to be at least partially torn away or removed from the carton to form a dispenser opening for removal and/or dispensing of the containers from the carton. A first portion of the tear line generally will extend laterally across the front of the exiting end of the carton, through the side end flaps, and then will be turned and extended upwardly through the side end flaps toward the first and second fold lines between the side panels and top panel. The tear line thereafter will include a section or portion that extends across the top panel.

In use, the opening section generally will be torn away from the exiting end of the carton along the tear line to form the dispenser opening through which containers or products stored within the carton can be removed. The opening section typically will be hingedly attached or pivoted rearwardly along the section of the tear line across the top panel to provide a recloseable flap, although it further can be completely separated from the carton via the tear line and removed as needed.

Alternatively, the tear line can be further extended along the first and second fold lines to enable removal of a more substantial portion, and potentially all of the top panel as needed or desired. In addition, the tear line can be extended through the side panels in locations spaced from and extending parallel to the fold lines between the top and side panels as needed to provide a further enlarged dispenser opening for the display and withdrawal or removal of products or containers from the carton.

Various objects, features, and advantages of the present invention will become apparent to those skilled in the art upon reading the following detailed description when taken in conjunction with the accompanying drawings.

DETAILED DESCRIPTION OF THE INVENTION

Figure 1:
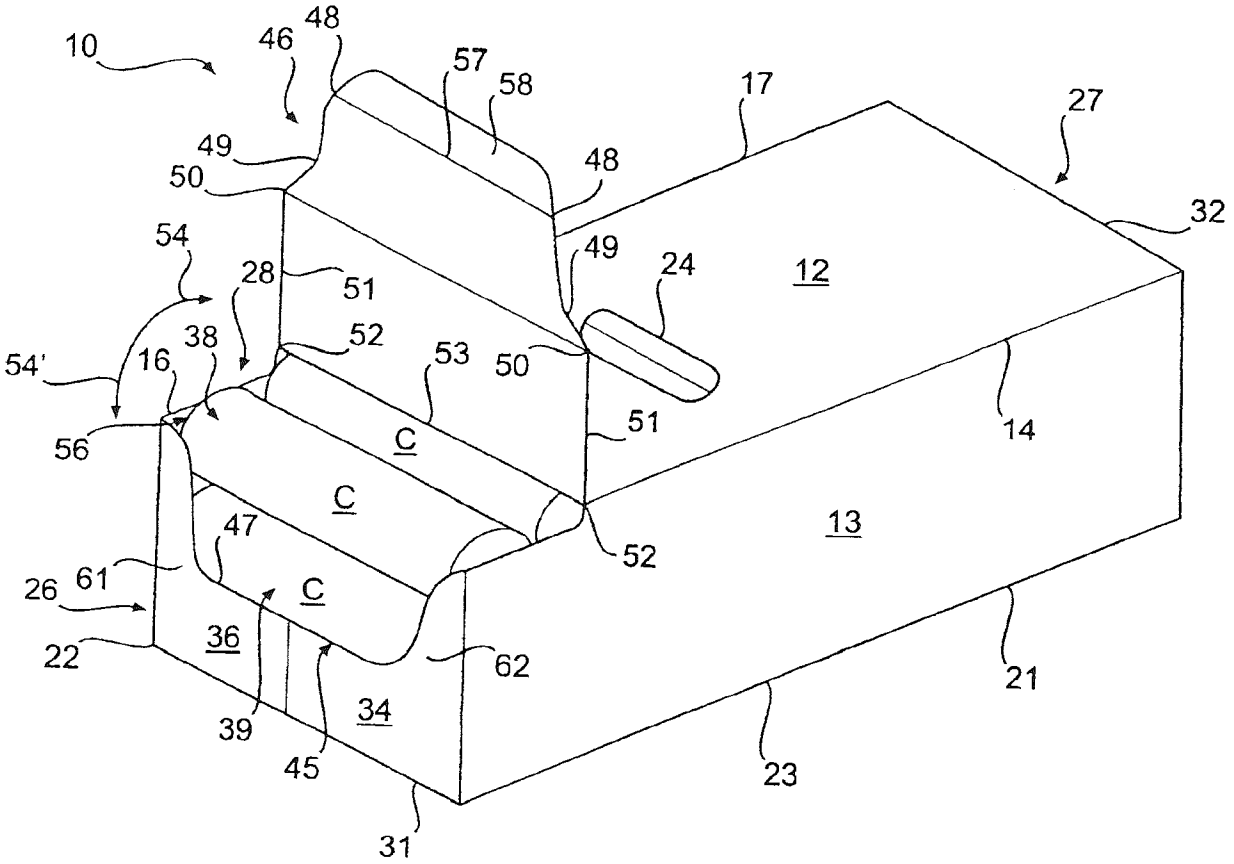
FIG. 1 is a perspective view of one example embodiment of the display/vending carton of the present invention.
Figure 2:
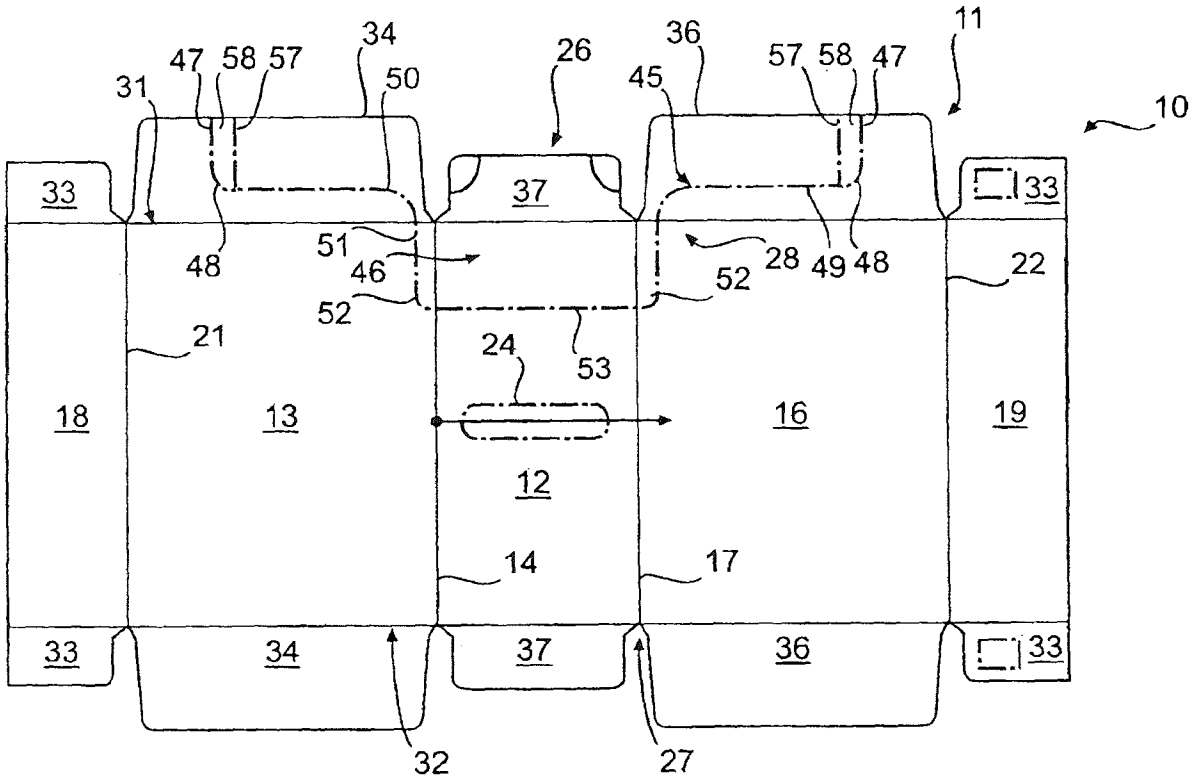
FIG. 2 is a plan view of a carton blank from which the display/vending carton according to FIG. 1 is formed.
Figure 3:
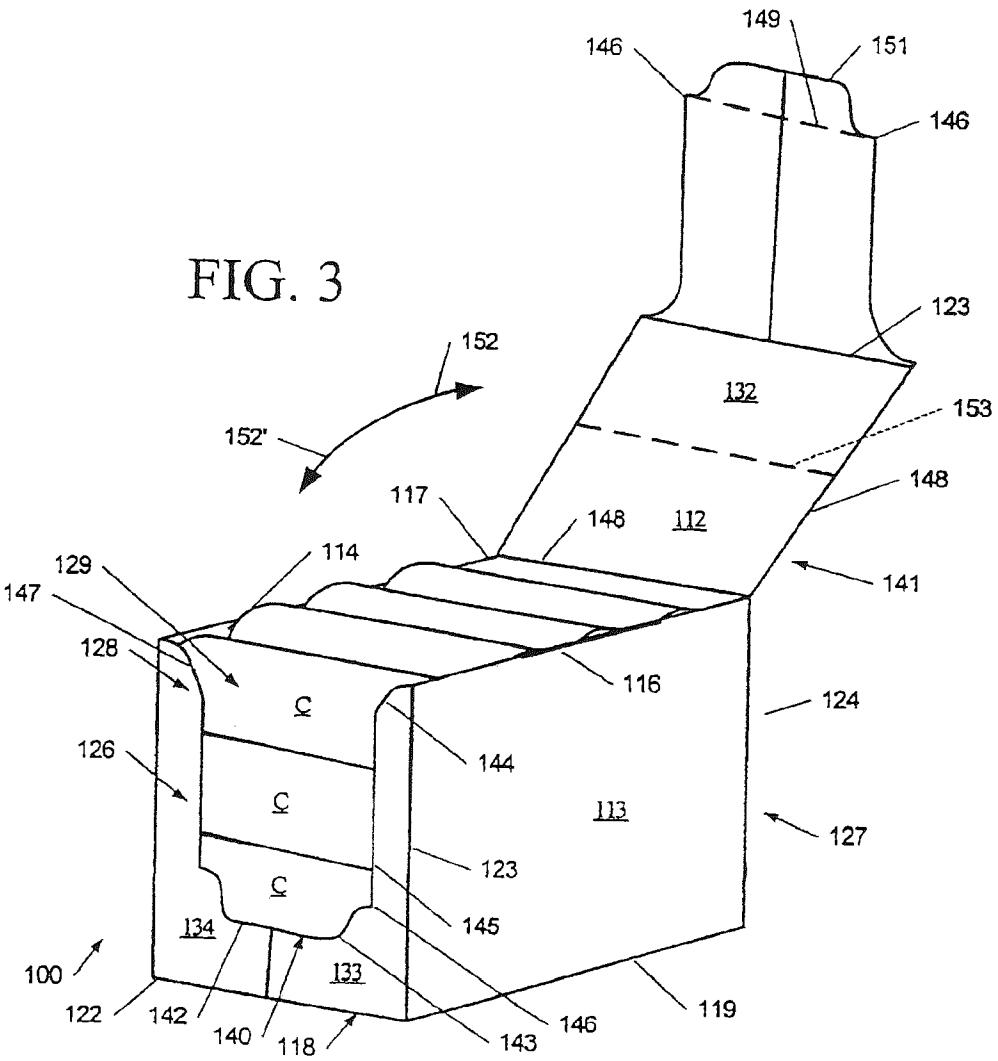
FIG. 3 is a perspective illustration of an additional, alternative embodiment of the display/vending carton of the present invention.

Referring now to the drawings in which like numerals indicate like parts throughout the several views, FIGS. 1-4 generally illustrate example embodiments of the display/vending carton 10/100 of the present invention, which is primarily designed for the storage, transport, display and vending of cans, bottles, and similar products. For example, the present application can be used with cans and bottles of the types used to contain soft drinks and beer or other liquid products, as well as cans or tubes of various types of food products such as frozen biscuits, rolls and the like. It will, however, also be understood that the present invention further can be adapted for use in the storage, transport, display and vending and/or dispensing of various other types or configurations of products other than substantially cylindrically shaped bottles or cans. In addition, while the cartons 10/100 of FIGS. 1 and 3 are shown with 2-3 rows of stacked containers C therein (i.e., in a 2×6, 3×4, etc. arrangement), it will be understood by those skilled in the art that the present invention is not restricted solely to two or three rows of containers, but rather can be used for storage, transport, display/vending, and/or dispensing of containers in a variety of varying arrangements or configurations, including 2×4, 2×5, 2×6, 3×4, 3×5, etc.

In a first embodiment of the present invention generally illustrated in FIGS. 1 and 2, the carton 10 generally will be formed from a carton blank 11 that itself is generally formed from a foldable sheet of material such as paperboard, cardboard, plastic or other, similar materials as commonly used in the packaging industry or field. As generally illustrated in FIG. 2, the carton blank 11, shown in a flat, unfolded configuration, includes a top panel 12 connected to a first side panel 13 by a first longitudinal fold line 14 and to a second side panel 16 by a second longitudinally extending fold line 17, which second fold line 17 extends parallel to the first fold line 14. The first and second side panels 13 and 16, respectively, are each attached at their edges opposite the top panel to first and second bottom flaps 18 and 19 by longitudinally extending third and fourth fold lines 21 and 22, respectively, which fold lines extend parallel to the first and second fold lines 14 and 16 as generally illustrated in FIG. 2. The bottom end flaps 18 and 19 generally are adapted to be folded together into an overlying configuration and attached together, typically with an adhesive material, although they also can be formed with mating tabs and slots (not shown) for locking the bottom flaps together to define and form a bottom panel 23 (FIG. 1) for the enclosed carton 10.

The carton 10 further generally includes a handle 24, which can be formed as a slot type handle as shown in FIGS. 1 and 2, but also can include other, various types of handles such as a "race track" handle or other known types of handle designs. The enclosed carton 10 further generally includes first and second closed ends 26 and 27, with the first end 26 further adapted to become a dispensing or exiting end at which a dispenser 28 (FIG. 1) for the carton is defined, through which containers C can be accessed and dispensed or removed from the carton.

As further shown in FIG. 2, the carton blank 11 additionally includes transverse fifth and sixth fold lines 31 and 32 that extend in a direction perpendicular or normal to the parallel longitudinal fold lines 14, 17, 21 and 22. The fifth and sixth transversely extending fold lines foldably connect the bottom flaps 18 and 19, side panels 13 and 16, and top panel 12 to a series of end flaps, including bottom end flaps 33, first and second side end flaps 34 and 36, and top panel end flaps 37.

In use, the blank 11 will be formed into a carton 10 (FIG. 1) by folding the bottom end flaps 18 and 19 (FIG. 2) inwardly, while the side panels 13 and 16 are folded with respect to the top panel 12 along the first and second fold lines 14 and 17 to form an open ended sleeve. The bottom end flaps then generally are attached or sealed together such as with an adhesive or glue material, although the use of other attachment mechanisms such as locking tabs and corresponding mating slots, or other locking openings formed in the bottom flaps also can be used. Typically, the containers C (FIG. 1) will be loaded into the carton sleeve through one end thereof, with their typically being at least two rows, illustrated at 38 and 39 in FIG. 1, of containers C. It will be understood by those skilled in the art that while this embodiment of the present invention shows the use of two parallel stacked rows of containers, the present invention also can be used with a single row of containers placed side by side, or with three or more parallel rows of stacked containers, such as shown in FIG. 3.

After the carton 10 (FIG. 1) has been fully loaded, the various end flaps at both ends 26 and 27 of the carton 10 generally are folded to a closed position and secured, such as by the application of glue or other adhesive materials or through the use of locking tabs and corresponding mating slots (not shown). For example, the bottom end flaps 33 can be folded upwardly to a closed position, after which the top end flaps 37 will be folded downwardly over the bottom end flaps. The first and second side end flaps 34 and 36 then are folded sideways over the bottom and top end flaps typically with glue or a similar adhesive material being applied therebetween to secure the side, bottom and top end flaps together for closing the ends of the carton 10.

As shown in FIG. 2, a tear line or line of weakness 45 is formed in the carton blank 11 through the side end flaps 34, 36, and through the top panel 12 adjacent the exiting end 26 of the carton. The tear line 45 generally will be formed from a series of perforations, cuts, nicks or scores stamped or otherwise formed in the material of the carton blank and define a removable opening section 46 that defines or creates the dispenser 28 at the exiting end 26 of the carton 10 as shown in FIG. 1.

The tear line 45 generally extends laterally across each of the first and second side end flaps 34 and 36 at the exiting end of the carton so as to define an initial or first lateral portion 47. As shown in FIG. 2, the tear line 45 extends across each of the side end flaps to a first point, 48, whereupon the tear line is turned approximately 60°-90°, or less, and extends along the length of each side end flap for second portions 49 extending substantially parallel to the fifth transverse fold line 31 of the carton blank 11. At a third turning point 50 adjacent the top end flap 37 and top panel 12, the tear line 45 again is turned and includes a third portion 51 that extends along each of the first and second side panels 13 and 16 in a direction parallel to the first and second fold lines 14 and 17, respectively, to a fourth turning point 52 that is spaced inwardly from the exiting end 26 of the carton. The fourth turning point 52 can be selected or formed at any predetermined distance from the exiting end 26 of the carton, but typically will be spaced along the top side panels approximately the diameter of one container C, or greater, as indicated in FIG. 1, for access and removal of a container from the carton.

At the fourth turning point 52 as shown in FIG. 2, the tear line or line of weakness 45 is turned approximately 70°-90° and generally includes a top panel portion or line of weakness 53 that can be formed as a part of the tear line or separately from the tear line 45 and extends laterally across the top panel in a direction substantially parallel to the fifth transverse fold line 31 and exiting end 26 of the carton. The laterally extending top panel portion 53 of the tear line 45 generally defines a hinge line or pivot line about which the removable opening section 46 can be pivoted in the direction of arrows 54 and 54' (FIG. 1) to form or define a dispenser opening 56 that generally is approximately the diameter of one container or greater for access and the dispensing or vending of containers C from within the carton as indicated in FIG. 1.

Still further, a fold line 57 (FIG. 2) can be formed in the removable opening section 46, extending laterally between the second portions 49 of the tear line 45 formed in each of the side panel end flaps, spaced from and extending substantially parallel to the lower or first lateral portion 47 of the tear line. The fold line 57 and first lateral portion 47 of the tear line 45 thus define a gripping or engagement portion or finger flap 58 for the removable opening section 46. In use, a user can push in the engaging portion 58 so as to separate the perforations of the tear lines 45 along the lower lateral portion 47 thereof, after which the removable opening section can be pulled or pivoted upwardly in the direction of arrow 54 to form and open the dispenser opening of the carton. Thereafter, if desired, the removable opening section can be pivoted downwardly in the direction of arrow 54' to re-close the dispenser opening as needed or desired, with the engaging portion 58 providing a tab or other portion by which the removable opening section can be gripped and moved between its opening and closed positions. It is also possible to completely separate the removable opening portion by separating the perforations of the tear line 45 along the laterally extending top panel portion 53 thereof.

The tear line of the present invention accordingly defines an angled bottom to top opening feature, which, when the opening section is at least partially removed, enables the removal of one or more containers or products at a time, while also enabling easy display and removal of the products therein by consumers. In addition, the design of the dispenser 28 includes front retainer portions or sections 61 and 62 that extend in a substantially L-shaped configuration that allows enhanced visibility of the products or containers within the carton, but restricts the containers from falling out of the cartons before dispensing is desired.

Figure 4:
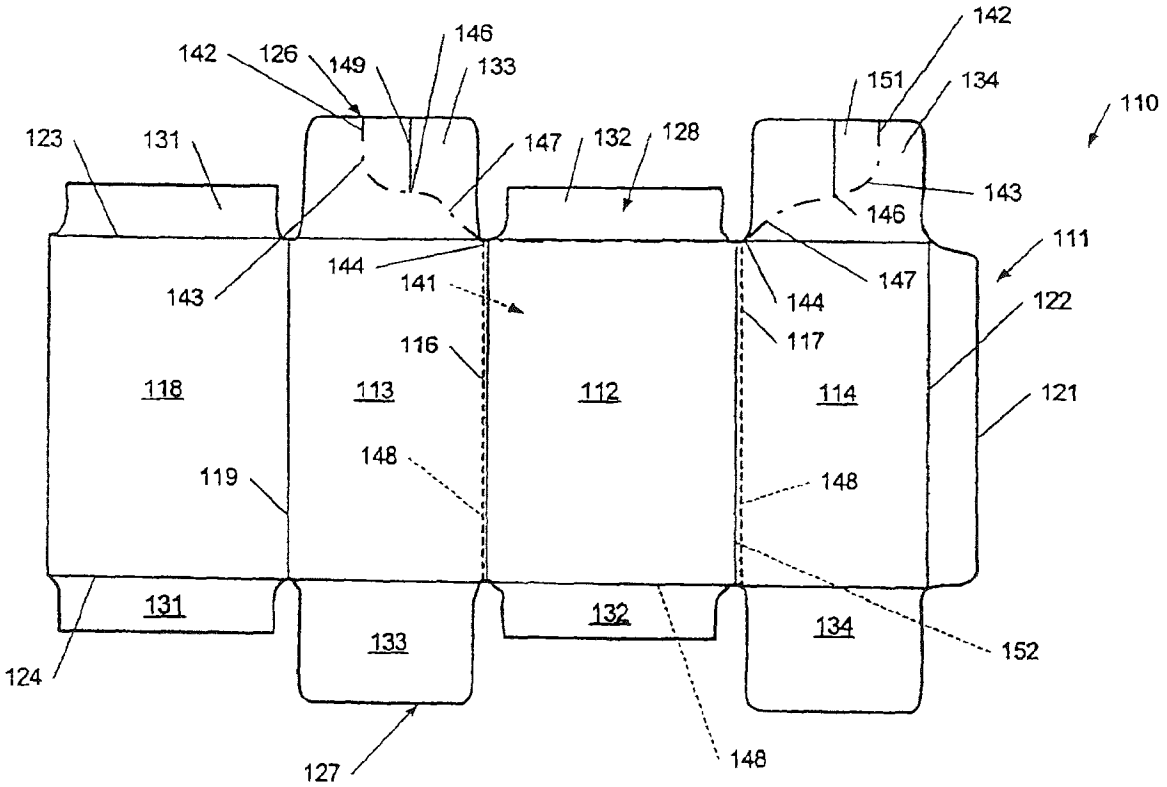
FIG. 4 is a plan view of a carton blank from which the display/vending carton of FIG. 3 is formed.

FIGS. 3 and 4 illustrate another example embodiment of a carton 100 of the present invention, which is designed with angled bottom to top opening feature to enable removal of products one at a time. As illustrated in FIG. 4, the carton generally is formed from a carton blank 111, typically formed from a paperboard, cardboard, synthetic or other similar carton material. In this embodiment, the carton blank generally includes a top panel 112 connected to first and second side panels 113 and 114 along first and second longitudinally extending fold lines 116 and 117, respectively. The first side panel 113 further is foldably connected to a bottom panel 118 along a third longitudinal fold line 119, while the second side panel 114 is connected to a bottom attachment flap 121 by a fourth longitudinally extending fold line 122. In use, the bottom flap 121 will be folded inwardly and attached to the bottom panel 118, such as by glue or other similar adhesive material, or can be locked together with the bottom panel via locking tabs and slots (not shown) to form an open ended sleeve for receipt of products therein. As discussed above with respect to FIGS. 1 and 2, the products typically will be received within the open-ended carton sleeve on their sides, arranged in parallel rows.

Transversely extending fifth and sixth fold lines 123 and 124 extend across the ends of the top, side and bottom panels at each end 126 and 127 of the carton 110. As indicated in FIG. 3, the first end 126 of the carton 110 generally is defined as an exiting end of the carton, at which a dispenser 128, having a dispenser opening 129, is defined and through which the containers C can be accessed and dispensed from the carton. Bottom, top, and first and second side end flaps 131-134, respectively, are attached to the bottom, top and first and second side panels at each end of the carton along the fifth and sixth transverse fold lines 123 and 124 as shown in FIG. 4. After the bottom, side and top panels have been folded into a sleeve or tube and loaded with products, the bottom, top and side panels 131-134 generally will be folded inwardly to a closed configuration to seal and close the opposite ends 126 and 127 of the carton and will be attached, typically with an adhesive material such as glue or other attachment mechanism to secure the flaps in their closed condition.

As further illustrated in FIG. 4, a tear line 140 or a line of weakness or separation is formed at the exiting end 260 of the carton blank such as by cutting, scoring, stamping or otherwise forming a series of scores, nicks, cuts or perforations in the blank. The tear line extends along the top panel 112 adjacent the first and second fold lines 116 and 117 to form a removable opening section 141 of the carton 110 (FIG. 3) for defining the dispenser 128 of the carton. The tear line 140 initially extends laterally across the first and second side end flaps 133 and 134 defining a lower, lateral or first portion 142 that extends across each of the first and second side end flaps between first turning points 143 at which the tear line is turned and extends at a curve or angle upwardly along each of the first and second side end flaps as shown in FIG. 4. The tear line can extend upwardly at an angle from the first turning points 143 to a second turning point 144 along each of the side end flaps. Alternatively, as indicated in FIG. 4, the tear line also can extend at an angle to a first intermediate point 146 and thereafter can be turned slightly and extend substantially parallel to the fifth transverse fold line 123 until it reaches the second turning points 144. Upon reaching turning points 144, the tear line generally again is turned and extends at an angle toward the first and second fold lines 116 and 117 between the top and first and second side panels, respectively.

As shown, the tear line typically will include an angled or curved portion 147 extending approximately between each of the first turning points 143 or the intermediate points 146 and the second turning point 144 adjacent the first and second fold lines 116 and 117, which angle can be varied up to approximately 90° to vary the size of the removable opening section 141 or dispenser opening 129, as desired. In addition, the angled portion 147 further can extend at least partially along the first and second side panels, such as in the embodiment shown in above in FIG. 2 as needed and desired for access to the containers within the carton 100 (FIG. 3) formed from the blank 111, FIG. 4. As further indicated in FIG. 4, the tear line 140 further generally can be extended substantially the length of the top panel, generally being extended along or adjacent and parallel to the first and second fold lines 116 and 117 as indicated in FIG. 4 by dashed lines 148. As a result, the removable section 141 thus can include substantially the entire top panel to define a dispenser opening 129 that extends substantially along the length of the carton to enable access and removal of entire rows of containers from within the carton as indicated in FIG. 3.

Still further, a fold line 149 can be formed in the front of the removable section 141 extending across the first and second side end flaps 133 and 134 (FIG. 4) and substantially parallel to the lateral portion 142 of the tear line between the first intermediate points 146. The fold line 149 defines a finger flap or engaging portion 151 for the removable opening section. In use, a user will press against the inner flap or engaging portion 151 so as to initiate the tearing or separation of the tear line along the lower lateral portion 142 thereof. To open the carton 100, the user can grip and pull or move the removable opening section 141 upwardly in the direction of arrow 152 as shown in FIG. 3, separating the removable section from the remainder of the carton along the tear line 140 to form the dispenser opening 129.

In this embodiment, the dispenser opening 129 is shown as being substantially the size of the top panel, i.e., with the top panel 112 being substantially removed from the carton so as to expose the entire upper row of containers C to enable easier and faster access and removal thereto. The removable opening section 141 further can be torn away or completely removed from the carton with the carton thus being used as a display and dispensing or vending carton such as in a retail environment. Alternatively, as shown in FIG. 3, essentially completely removing the top panel enables access to all containers C stored within the carton 100 and permits the next containers to roll or drop down into a forward position for easier access and removal, while at the same time, enabling enhanced visibility of the containers within the carton while they are retained and prevented from falling out of the carton. It is also possible, however, to form one or more fold or tear lines or lines of weakness, such as indicated by dashed lines 153 in FIG. 3, along the top panel at spaced locations. This will enable only partial removal of part of the top panel 112 as needed for controlling access to the containers contained within the carton and, in instances where the carton will be resealed, the removable section can be lowered back to a closed position as indicated by arrow 152'.

It will be understood by those skilled in the art that while the present invention has been discussed above with respect to various preferred embodiments and/or features thereof, numerous changes, modifications, additions and deletions can be made thereto without departing from the spirit and scope of the invention as set forth in the following claims.

What is claimed is:

1. A method of opening a carton containing a plurality of containers disposed on their container sides in at least one row when the carton is in an unopened configuration; the carton including six sides; the six sides including a top panel connected along a portion of a first fold line to an end of the carton, a first side panel foldably connected to at least the top panel, and a second side panel foldably connected to at least the top panel, the end comprising a first side end flap foldably connected to the first side panel at a respective portion of the first fold line, a second side end flap foldably connected to the second side panel at a respective portion of the first fold line, and a top end flap foldably connected to the top panel at a respective portion of the first fold line, the top panel, the first side end flap, and the first side panel at least partially forming a first corner of the carton, and the top panel, the second side end flap, and the second side panel at least partially forming a second corner of the carton; the carton including a dispensing feature defined at least partially by tear line segments, including at least a first tear line segment, a second tear line segment, and a third tear line segment; the first tear line segment intersects the first corner and extends away from the first corner to a first turning point in the first side end flap such that the first tear line segment is spaced apart from each of the top panel and the first side panel and each respective portion of the first fold line in the first side end flap, and the first tear line segment intersects the second corner and extends away from the second corner to a second turning point in the second side end flap such that the first tear line segment is spaced apart from each of the top panel and the second side panel in the second side end flap and each respective portion of the first fold line, the first tear line segment extending parallel to the first side panel and the second side panel from the first turning point and from the second turning point, the first side panel being foldably connected to the top panel along at least the second tear line segment, the second side panel being foldably connected to the top panel along at least the third tear line segment, the second tear line segment extending from the first corner, and the third tear line segment extending from the second corner; the dispensing feature including at least a portion of the first fold line and extending at least partially in the top panel and at least partially in the end; the method comprising:

resting the carton on a surface to dispose the top panel at a top of the carton over the plurality of containers with the container sides of the plurality of containers being parallel the top panel;

separating the dispensing feature along the first tear line segment in the end by pulling the dispensing feature upwardly; and separating the dispensing feature in the top panel after the first tear line segment in the end is separated;

wherein every container of the plurality of containers disposed in the carton in the unopened configuration is retained in the carton after separating the dispensing flap from the end.

2. The method of claim 1 wherein an engagement portion is disposed adjacent the dispensing feature.

3. The method of claim 2 wherein the engagement portion is connected along a finger flap fold line to the dispensing feature.

4. The method of claim 1 wherein the dispensing feature can remain attached to the carton when the opening is formed.

5. The method of claim 1 wherein the dispensing feature can be entirely removed from the carton.

6. The method of claim 1 wherein the carton is made from paperboard.

7. The method of claim 1 wherein structural integrity of the carton is maintained after the opening is formed.

8. The method of claim 1 wherein the containers are cylindrical.

9. The method of claim 1 wherein at least one line of weakness extends across the top panel.

10. The method of claim 1, wherein the at least one row comprises a plurality of rows, and an endmost container of each row of the plurality of rows that is adjacent the dispensing feature is disposed in parallel stacked relation after separating the dispensing flap from the end.

11. The method of claim 1 wherein an engagement portion is disposed adjacent the dispensing feature in the end and is spaced apart from the top panel, and the separating the dispensing feature along the first tear line segment in the end comprises pushing the engagement portion prior to the pulling the dispensing feature upwardly.

12. The method of claim 11, wherein the tear line segments define a lateral portion and the finger flap extends from the lateral portion to the finger flap fold line, and the separating the dispensing feature along the first tear line segment in the end comprises separating the finger flap from the end along at least the lateral portion.

13. The method of claim 1, wherein the at least one row comprises at least a first row, a second row, and a third row, the second row being stacked on the first row and the third row being stacked on the second row.

14. The method of claim 1, wherein the end is a first end, the six sides further include a second end disposed opposite to the first end, the top panel, the second end, and the first side panel at least partially form a third corner of the carton, the second tear line segment extends from the first corner to the third corner, the top panel, the second end, and the second side panel at least partially form a fourth corner of the carton, and the third tear line segment extends from the second corner to the fourth corner.

15. The method of claim 1, wherein the at least one row of containers is a plurality of stacked rows of containers, and a front container of each of the stacked rows of containers is retained by the end of the carton after separating the dispensing flap from the end.

16. An enclosed carton for a plurality of containers disposed on their container sides in at least one row when the carton is in an unopened configuration, the plurality of containers including a first container, the carton comprising:

six sides including a top panel connected along a portion of a first fold line to an end of the carton, a first side panel foldably connected to at least the top panel, and a second side panel foldably connected to at least the top panel, the end comprising a first side end flap foldably connected to the first side panel at a respective portion of the first fold line, a second side end flap foldably connected to the second side panel at a respective portion of the first fold line, and a top end flap foldably connected to the top panel at a respective portion of the first fold line, the top panel, the first side end flap, and the first side panel at least partially forming a first corner of the carton, and the top panel, the second side end flap, and the second side panel at least partially forming a second corner of the carton;

a dispensing feature defined at least partially by tear line segments in the top panel and in the end, the tear line segments including at least a first tear line segment extending in the end, a second tear line segment extending from the first corner, and a third tear line segment extending from the second corner, the first tear line segment intersects the first corner and extends away from the first corner to a first turning point in the first side end flap such that the first tear line segment is spaced apart from each of the top panel and the first side panel and each respective portion of the first fold line in the first side end flap, and the first tear line segment intersects the second corner and extends away from the second corner to a second turning point in the second side end flap such that the first tear line segment is spaced apart from each of the top panel and the second side panel and each respective portion of the first fold line in the second side end flap, the first tear line segment extending parallel to the first side panel and the second side panel from the first turning point and from the second turning point, the first side panel being foldably connected to the top panel along at least the second tear line segment, and the second side panel being foldably connected to the top panel along at least the third tear line segment; the dispensing feature including at least a portion of the first fold line and extending at least partially in the top panel and at least partially in the end;

wherein, when the carton is rested on a surface to dispose the top panel at a top of the carton over the plurality of containers with the container sides of the plurality of containers being parallel the top panel, an opening is formed by separating the dispensing feature at least partially along the tear line segments in the top panel and at least partially along the tear line segments in the end;

an engaging portion in the end, the engaging portion comprising a finger flap at least partially defined by at least one of the tear line segments and a finger flap fold line extending in the dispensing feature in the end; the engaging portion capable of being gripped and pulled upwardly to separate the dispensing feature along the tear line segments in the end; and after the tear line segments in the end are separated, the dispensing feature continues to be separated along the tear line segments in the top panel;

wherein every container of the plurality of containers disposed in the carton in the unopened configuration is retained in the carton after separating the engaging portion from the end.

17. The carton of claim 16 wherein the dispensing feature can remain attached to the carton when the opening is formed.

18. The carton of claim 16 wherein the dispensing feature can be entirely removed from the carton.

19. The carton of claim 16 wherein the carton is made from paperboard.

20. The carton of claim 16 wherein structural integrity of the carton is maintained after the opening is formed.

21. The carton of claim 16 wherein the containers are cylindrical.

22. The carton of claim 16 wherein at least one line of weakness extends across the top panel.

23. The carton of claim 16, wherein the at least one row comprises a plurality of rows, and an endmost container of each row of the plurality of rows that is adjacent the dispensing feature is disposed in parallel stacked relation after separating the dispensing feature from the end.

24. The carton of claim 16, wherein the tear line segments define a lateral portion and the finger flap extends from the lateral portion to the finger flap fold line, the finger flap being separable from the end along at least the lateral portion.

25. The carton of claim 24, wherein the lateral portion and the finger flap fold line are parallel to the container sides of the plurality of containers.

26. The carton of claim 16, wherein the engaging portion is spaced apart from the top panel.

27. The carton of claim 16, wherein the at least one row comprises at least a first row, a second row, and a third row, the second row being stacked on the first row and the third row being stacked on the second row.

28. The carton of claim 16, wherein the end is a first end, the six sides further include a second end disposed opposite to the first end, the top panel, the second end, and the first side panel at least partially form a third corner of the carton, the second tear line segment extends from the first corner to the third corner, the top panel, the second end, and the second side panel at least partially form a fourth corner of the carton, and the third tear line segment extends from the second corner to the fourth corner.

29. The carton of claim 16, wherein the at least one row of containers is a plurality of stacked rows of containers, and a front container of each of the stacked rows of containers in the unopened configuration is retained by the end of the carton after separating the dispensing feature from the end.

* * * * *